US009759506B2

(12) United States Patent
Domholt et al.

(10) Patent No.: US 9,759,506 B2
(45) Date of Patent: Sep. 12, 2017

(54) BATTERY-POWERED MOTOR UNIT

(71) Applicant: NPC Robotics, Inc., Mound, MN (US)

(72) Inventors: Norman L. Domholt, Excelsior, MN (US); Richard Reid, St. Louis Park, MN (US); John David, Plymouth, MN (US); Tyler Andrew Jacobson, Chaska, MN (US); Michael Richmon Thoreson, Mound, MN (US)

(73) Assignee: NPC Robotics, Inc., Mound, MN (US)

( * ) Notice: Subject to any disclaimer, the term of this patent is extended or adjusted under 35 U.S.C. 154(b) by 303 days.

(21) Appl. No.: 13/895,787

(22) Filed: May 16, 2013

(65) Prior Publication Data

US 2013/0247748 A1 Sep. 26, 2013

Related U.S. Application Data

(62) Division of application No. 12/751,254, filed on Mar. 31, 2010, now Pat. No. 8,443,710.

(60) Provisional application No. 61/165,310, filed on Mar. 31, 2009.

(51) Int. Cl.

| | |
|---|---|
| ***F41A 27/20*** | (2006.01) |
| ***F41A 23/24*** | (2006.01) |
| ***F41A 27/18*** | (2006.01) |
| ***F41G 5/14*** | (2006.01) |

(52) U.S. Cl.

CPC ..... *F41A 27/20* (2013.01); *F41A 23/24* (2013.01); *F41A 27/18* (2013.01); *F41G 5/14* (2013.01)

(58) Field of Classification Search

CPC ..... F41A 23/24; F41A 27/20

USPC ..... 89/40.03–40.04, 41.01–41.02, 89/37.11–37.13; 318/139; 114/5–8

See application file for complete search history.

(56) References Cited

U.S. PATENT DOCUMENTS

| | | | | |
|---|---|---|---|---|
| 2,388,509 A * | 11/1945 | Trotter | 89/41.21 | |
| 2,411,114 A * | 11/1946 | Beckton et al. | 89/37.17 | |
| 2,437,646 A * | 3/1948 | Matulaitis | F41A 27/20 180/6.58 | |
| 2,453,173 A * | 11/1948 | Wright et al. | 250/204 | |
| 2,594,198 A * | 4/1952 | Motley | 89/37.01 | |
| 2,933,981 A * | 4/1960 | Anderson | F41A 9/04 89/1.804 | |
| 3,198,456 A | 8/1965 | Wood | | |

(Continued)

OTHER PUBLICATIONS

File History for co-owned, U.S. Pat. No. 8,443,710, "Battery-Powered Motor Unit," issued May 21, 2013 175 pages.

*Primary Examiner* — Stephen M Johnson
*Assistant Examiner* — Benjamin Gomberg
(74) *Attorney, Agent, or Firm* — Craige Thompson; Thompson Patent Law

(57) ABSTRACT

The technology disclosed herein can include a motor unit having a motor with a motor gear to rotate a drive shaft and a drive gear. A manual input shaft can also be configured to transmit rotation to the drive shaft. The motor can have a central axis that forms an angle of less than 90 degrees with a plane substantially defined by an outer surface of a gear box coupled to the motor. A mounting bracket is configured to allow mechanical communication between the motor unit and an internal ring gear. The internal ring gear can be mounted to a vehicle and a turret can be pivotably disposed within the internal ring gear. A motor unit is mounted on the turret and a drive gear is rotatably mounted on the motor unit and in direct engagement with the internal ring gear.

20 Claims, 15 Drawing Sheets

(56) References Cited

U.S. PATENT DOCUMENTS

| | | | | |
|---|---|---|---|---|
| 3,429,222 | A | 2/1969 | Whiston et al. | |
| 3,937,540 | A | 2/1976 | Morizur | |
| 4,197,953 | A | 4/1980 | Frick | |
| 4,201,305 | A | 5/1980 | Frick | |
| 4,338,853 | A | 7/1982 | Neumeyer | |
| 4,524,655 | A | 6/1985 | Waldron et al. | |
| 4,527,458 | A | 7/1985 | Johnson | |
| 4,579,036 | A | 4/1986 | LeBlanc | |
| 4,686,888 | A * | 8/1987 | Sanborn | F41A 23/34 89/37.13 |
| 6,101,917 | A | 8/2000 | Klatte et al. | |
| 7,030,579 | B1 | 4/2006 | Schmitz et al. | |
| 7,895,932 | B1 * | 3/2011 | Ohnstad | F41H 5/20 89/36.13 |
| 8,443,710 | B2 | 5/2013 | Domholt et al. | |
| 8,607,686 | B2 * | 12/2013 | McKee | F41A 27/20 89/41.01 |

* cited by examiner

BATTERY-POWERED MOTOR UNIT

This application is a divisional of U.S. patent application Ser. No. 12/751,254, filed Mar. 31, 2010, now U.S. Pat. No. 8,443,710, which is a non-provisional application of U.S. Provisional Application No. 61/165,310, filed Mar. 31, 2009, the entire contents of which are incorporated herein by reference.

BACKGROUND

U.S. Pat. No. 7,030,579, shows a system for use with a rotatable turret that is mounted on a vehicle. The turret is generally separate from the vehicle frame and generally rotates in the vehicle frame. The system is generally operated by an operator. The operator can rotate the turret relative to the position of the vehicle body. The operator may operate a user interface to effect the desired rotation of the turret.

A power supply can be mounted on the turret. A motor unit is coupled to the underside of the turret. The power supply is generally mounted on the vehicle frame and supplies electrical power to the motor through a controller. As such, the system is generally implemented as a retrofit kit to provide a manually rotated turret with a motorized turret rotating system. The manual and motorized aspects of the turret rotating system are provided using separate components. Improved battery powered motor units for moving a turret are needed.

SUMMARY

The technology as described herein relates generally to a system for rotating a second structure relative to a first structure, such as rotating a turret relative to a vehicle. In one embodiment a drive gear is in mechanical communication with the drive shaft. A motor having a motor gear is also in communication with the drive shaft and is configured to cause rotation of the drive shaft. Further, the system has a manual input shaft that is configured to transmit rotation to the drive shaft. The motor unit is also configured to be in mechanical communication with and cause rotation of a turret on a vehicle.

Another embodiment has a gear box where a plane is substantially defined by an outer surface of the gear box. This embodiment also has a motor unit having a central axis. The angle between the central axis of the motor and the plane of the gear box is less than 90 degrees.

In another embodiment a gear box houses one or more gears and has an outer surface defining an opening. A motor housing is coupled to the outer surface of the gear box over the opening. A motor gear has a central axis, is disposed within the motor housing, and extends through the opening of the gear box. The angle between the central axis of the motor gear and the plane defined by the opening is less than 90 degrees.

In yet another embodiment of the technology disclosed herein, a bracket assembly has a mounting bracket configured to mount to a structure. A first motor unit coupler and a mounting bracket are configured to allow mechanical communication between the motor unit and an internal ring gear. As such, a first motor unit coupler is configured to couple to a motor unit. The motor unit coupler also has a first slide flange that is configured to be slidably received by the mounting bracket in at least a first slide channel. In another embodiment an internal ring gear is mounted to a vehicle with a turret pivotably disposed within the internal ring gear. A motor unit is mounted on the turret and a drive gear is rotatably mounted on the motor unit and in direct engagement with the internal ring gear. Such embodiment can also include a motor and a drive shaft in mechanical communication with the motor, where the drive shaft is fixed to the drive gear.

Another aspect of the technology disclosed herein is a method of mounting a housing to a turret. A first mating surface on a housing is mated to a second mating surface on a mounting bracket. A pin is inserted at least partially through substantially aligned openings defined by the first mating surface and the second mating surface.

Yet another aspect of the technology disclosed herein includes a ring gear that is a single piece of material defining an inverted ring gear configured to be coupled to a vehicle and be in mechanical communication with a turret. One or more stand-offs can be coupled to the ring gear.

BRIEF DESCRIPTION OF THE DRAWINGS

The invention may be more completely understood and appreciated in consideration of the following detailed description of various embodiments of the invention in connection with the accompanying drawings.

DETAILED DESCRIPTION

Turret mechanisms are incorporated into military vehicles to rotate weaponry, and other instruments placed on the turret, relative to the vehicle. The turret can be configured to be manually or mechanically rotated. In some approaches, the turret is mechanically rotated with assistance of a motor or the like. The motor often is electrically coupled to a vehicle battery, and is in mechanical communication with the turret. In the event of electrical or mechanical failure of the motorized system, a manual system is often engaged such that the turret can be manually rotated. Existing motorized and manual systems generally have had hundreds of components, making it a challenge to fit the motorized system to the turret assembly such that operator space is not encroached upon. Also, replacement of the motorized system can be time-consuming.

As used herein, the phrase "mechanical communication" is used to describe the configuration of at least two components where at least one component is configured to transmit kinetic energy to at least one other component. Generally, such components can be directly attached, indirectly attached, directly interfacing with, and/or indirectly interfacing with. The term "direct engagement" is used to describe the configuration of two or more components that are in physical contact.

Figure 1:
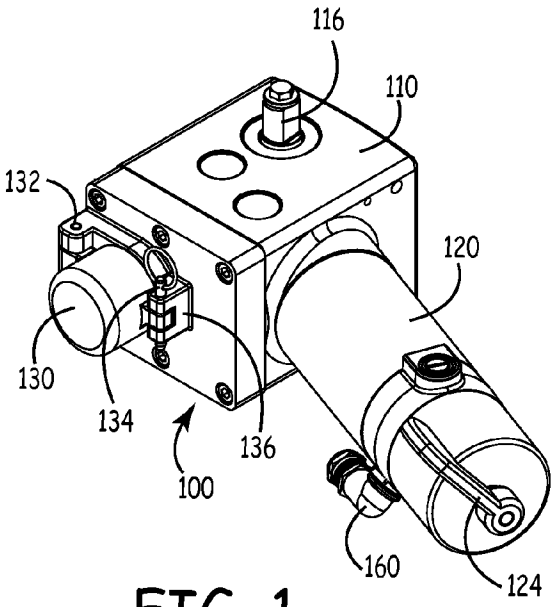
FIG. 1 is a perspective view of an embodiment of a motor unit including a motor and a gear box, consistent with the technology disclosed herein.
Figure 2:
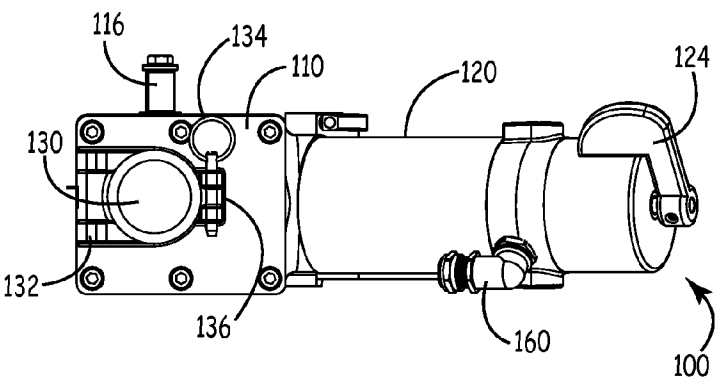
FIG. 2 is a side view of the embodiment of FIG. 1 consistent with the technology disclosed herein.
Figure 9:
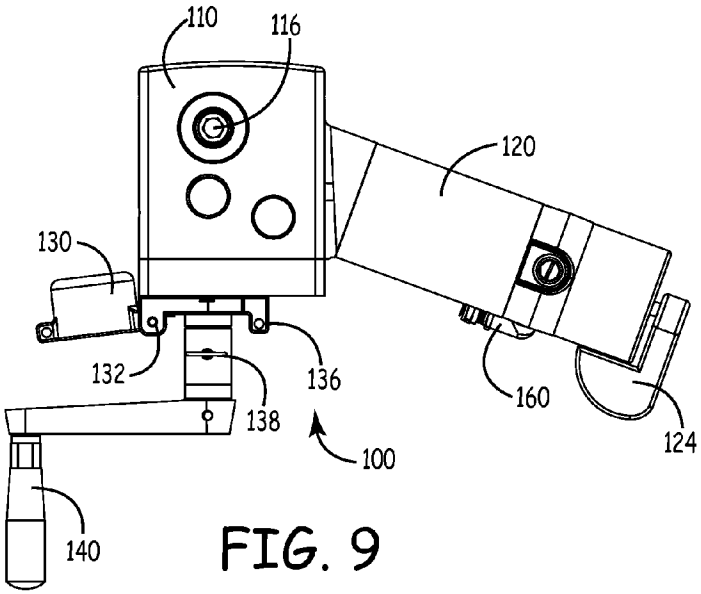
FIG. 9 is a top view of the embodiment of FIG. 7 consistent with the technology disclosed herein.
Figure 9A:
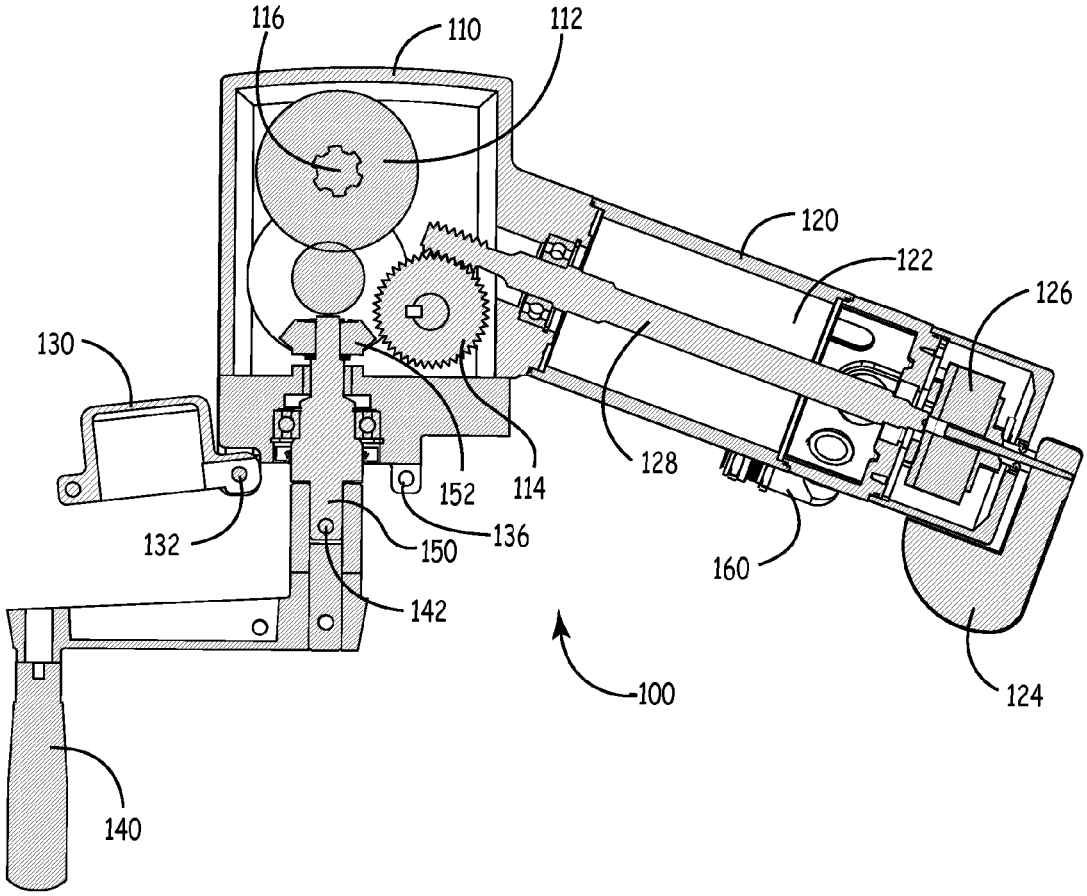
FIG. 9A is a cross-sectional top view of the embodiment of FIG. 7 consistent with the technology disclosed herein.
Figure 10:
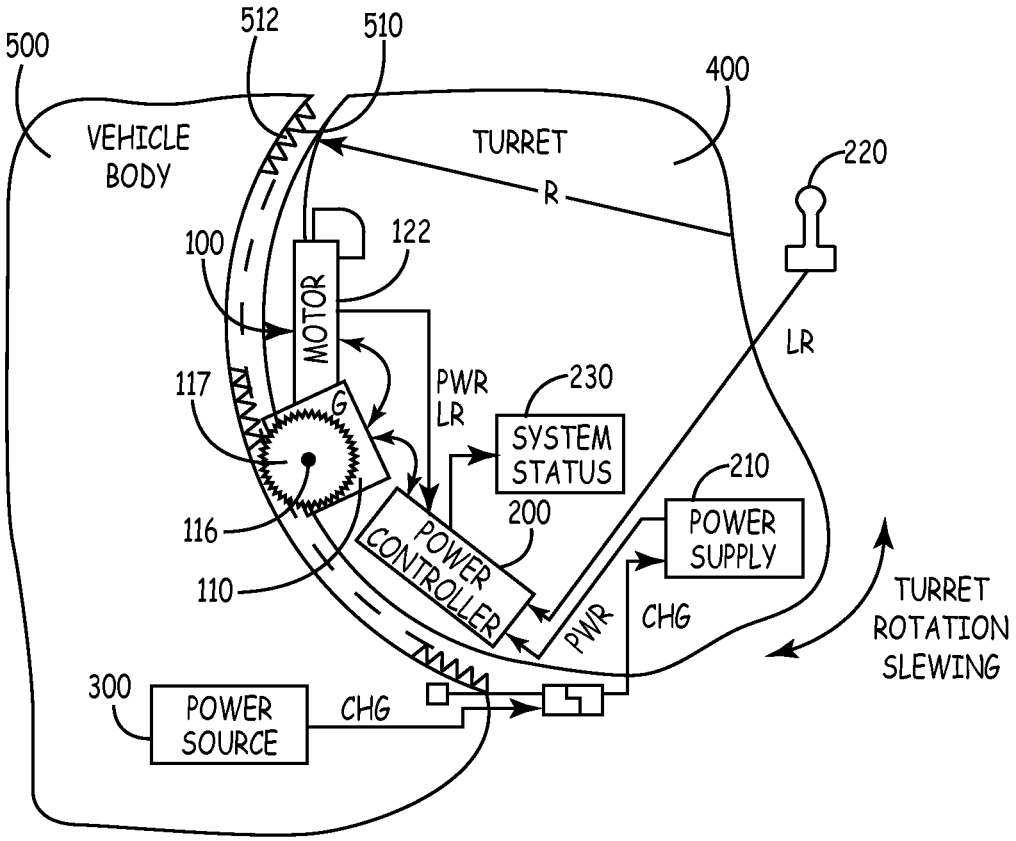
FIG. 10 is a schematic of a motorized system consistent with the technology disclosed herein in operative communication with a turret of a vehicle.
Figure 11:
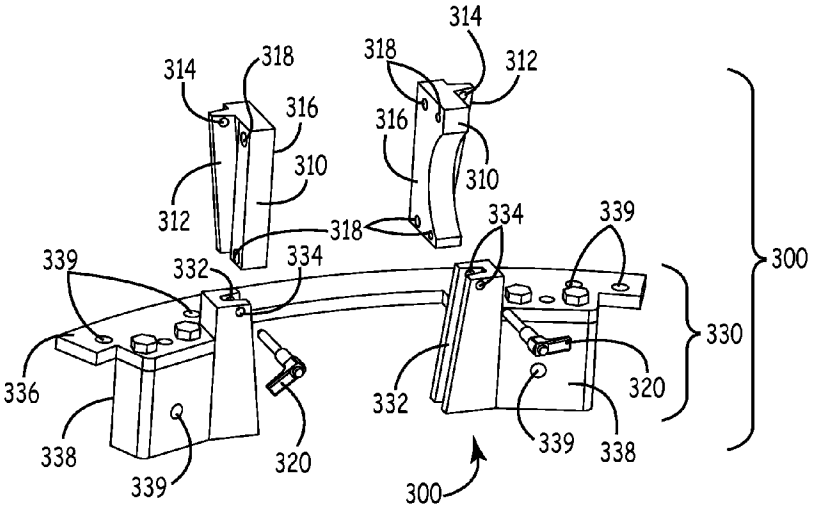
FIG. 11 is a perspective exploded view of a mounting bracket consistent with the technology disclosed herein.
Figure 12:
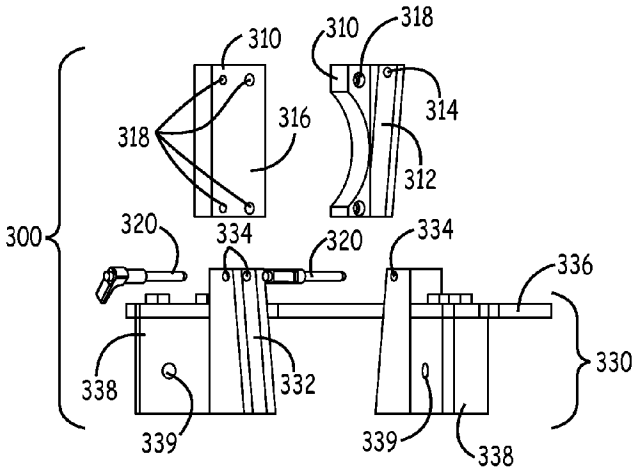
FIG. 12 is a side view of a mounting bracket consistent with the technology disclosed herein.
Figure 13:
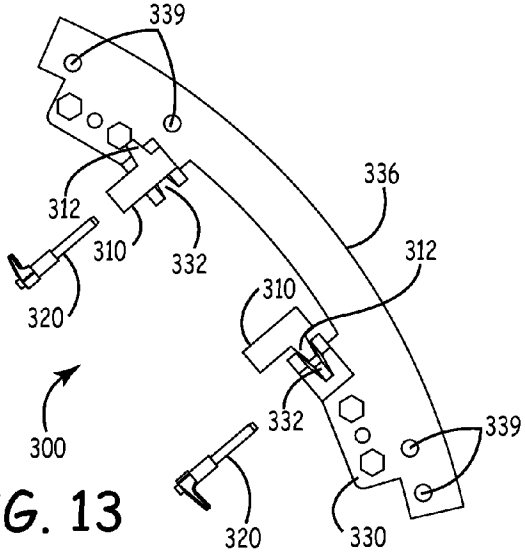
FIG. 13 is a top view of a mounting bracket consistent with the technology disclosed herein.
Figure 14:
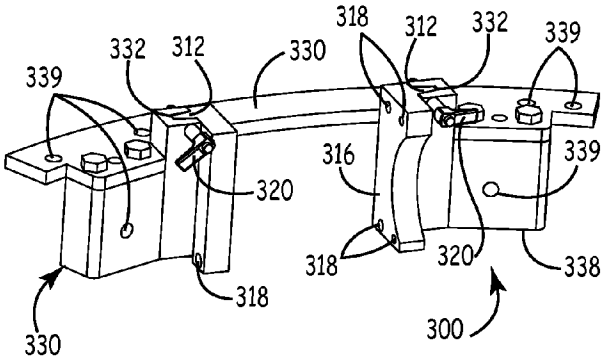
FIG. 14 is a perspective view of a mounting bracket consistent with the technology disclosed herein.
Figure 15:
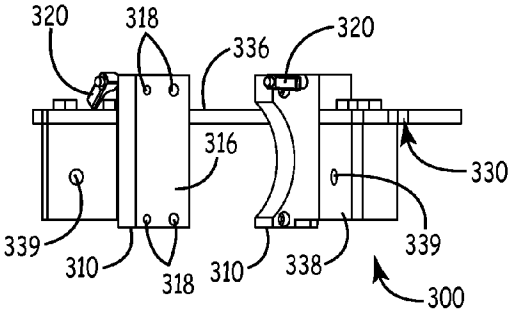
FIG. 15 is a side view of a mounting bracket consistent with the technology disclosed herein.
Figure 16:
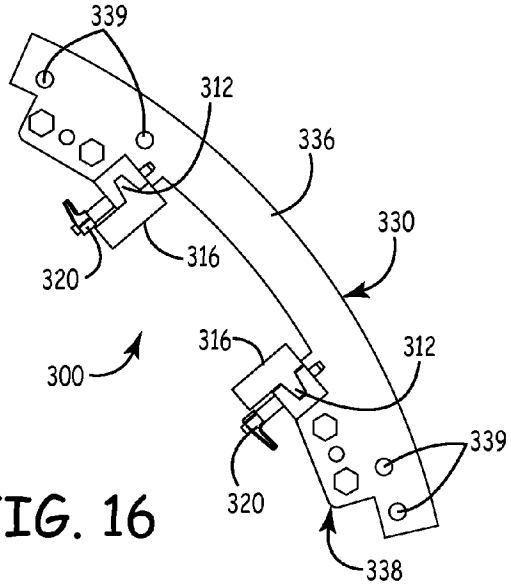
FIG. 16 is a top view of a mounting bracket consistent with the technology disclosed herein.

FIG. 10 is a schematic of a motorized system consistent with the technology disclosed herein in operative communication with a turret of a vehicle. The motorized system 100 has a gear box 110 having a gear system and a motor housing 120 (depicted in FIG. 1) having a motor 122 (also represented in FIG. 9A) that are in mechanical communication. The motor is an electric motor in a variety of embodiments.

A power supply 210 is electrically coupled to the motor 122. An electrical connector 160 (depicted in FIG. 1) coupled to the motor housing 120 (depicted in FIG. 1) interfaces an electrical cord to the motor 122. The electrical cord can couple a power controller 200 to the motor 122, where the power controller 200 regulates power supplied to the motor 122 from the power supply 210. The power supply 210 can be a vehicle battery, a stand-alone battery, or the like. Although the schematic depicts the power supply 210 on a turret 400, the power supply 210 can be in other locations instead. Other types of power supplies 210 can be used including AC or DC current sources. In at least one embodiment the motor operates at 24 Volts DC.

The power supply 210 is coupled to a power source 300 that is configured to generate power and charge the power supply 210. The power source 300 is a vehicle alternator in one embodiment, although the power source 300 could be other sources of power including a solar panel, for example. Inclusion of a power source 300 can allow for the disclosed system to be continuously charged while the vehicle in running, which allows the system the ability to be used for a period of time even when the vehicle is not running.

In another embodiment the electrical connector 160 (depicted in FIG. 1) couples the power source 300 such as a vehicle alternator directly to the motor 122. In such a configuration the system will not have power when the vehicle is shut off, unless a back-up source of power is provided. In yet another embodiment the power controller 200 can be eliminated such that the motor 122 is directly coupled to the power supply 210 with at least an on/off switch there-between. In a variation of this embodiment, the motor 122 could be directly coupled to the power source 300 with at least an on/off switch there-between.

An electrical cord can also couple to a power controller 200 that is in communication with a user interface 220, such that the user interface 220 can be in further communication with the motor 122. One example of a user interface 220 is a user input device, such as a joystick, although other user interfaces can be incorporated into the system such as switches. In another embodiment, the user interface 220 can be wirelessly coupled to the power controller 200. Another example of a user interface is system indicator lights.

The power controller 200 can also collect information from the system and provide such information to an operator through a user interface that is an output, such as a system status interface 230. The system status interface 230 can incorporate indicator lights, for example, such as LED indicator lights where each light signifies a different system status to an operator. Each indicator light can have a different color. System status indicators will be described in more detail, below.

Motorized System Configuration

The gear box 110 houses gears that transfer rotation from the motor 120 to a drive gear 117, which drives rotation of the turret 400. As visible in FIG. 3, among other figures, the motorized system 100 has a gear box 110 coupled to a motor housing 120. The gear box 110 can have a variety of shapes, and in the current embodiment is generally a box having an outer surface substantially defining at least a first plane 118. The gear box 110 is shaped to contain the gears found therein. The motor housing 120 is cylindrical in shape, but it will be appreciated that the motor housing 120 can have a variety of shapes and be consistent with the technology disclosed herein. The motor housing 120 is shaped to contain the motor 122 (depicted in FIG. 9A). The motor housing 120 is also shaped to contain most of the motor gear (128 in FIG. 9A). However, there is an end portion of the motor gear that interfaces with the gear box and is not within the motor housing 120.

Figure 3:
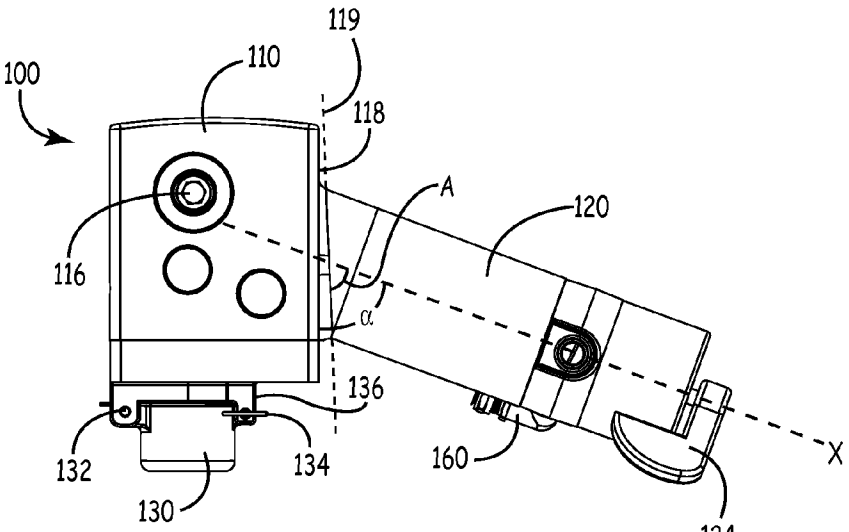
FIG. 3 is a top view of the embodiment of FIG. 1 consistent with the technology disclosed herein.

Still in reference to FIG. 3, the motor 122 has a central axis x along its length and is coupled to the gear box 110. An angle $\alpha$ is defined between the central axis x and the first plane 118. The angle $\alpha$ is less than 90 degrees.

In another embodiment, the central axis x forms an angle A with a second plane 119 defined by the intersection of the gear box 110 and the motor housing 120. The angle A is less than 90 degrees between the second plane 119 and the central axis x.

In yet another embodiment, best depicted in FIG. 5, a manual input shaft 150 (which will be described below) has a central axis y that forms an angle $\gamma$ with the central axis x of the motor housing 120. The angle $\gamma$ is less than 90 degrees between the central axis y and the central axis x.

The configuration of the motor housing 120 attached to the gear box 110 can have a variety of implementations in practice of the technology disclosed herein, but such configuration generally allows the motorized system 100 to fit within a circumference defined by a disk such as a turret having a particular radius R as depicted, for example, in FIG. 10.

In some prior art systems for a motor for a turret, such as described in U.S. Pat. No. 7,030,579, the motor and the gearbox have been substantially aligned with each other, so as to define a 180 degree angle between a plane of a gear box and an axis of the motor. The result was a relatively longer piece of equipment that is more difficult to accommodate in the cramped quarters of a turret mechanism having a curved boundary.

Figure 25:
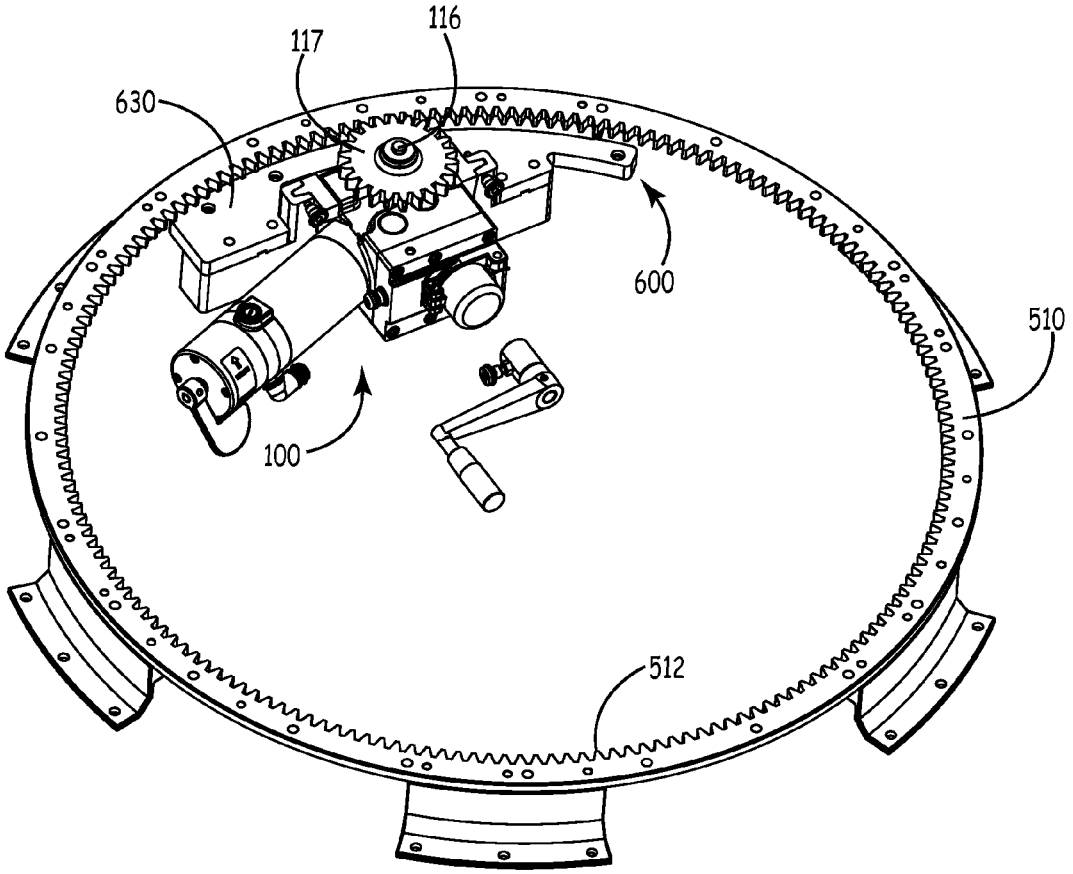
FIG. 25 depicts a ring gear in communication with a motor unit, consistent with the technology disclosed herein.
Figure 26:
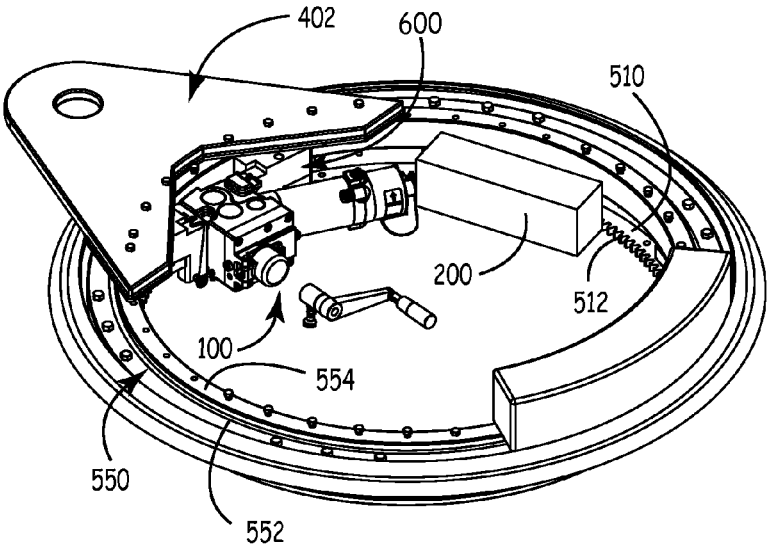
FIG. 26 depicts a ring gear in communication with a motor unit and a bearing, consistent with the technology disclosed herein.
Figure 29:
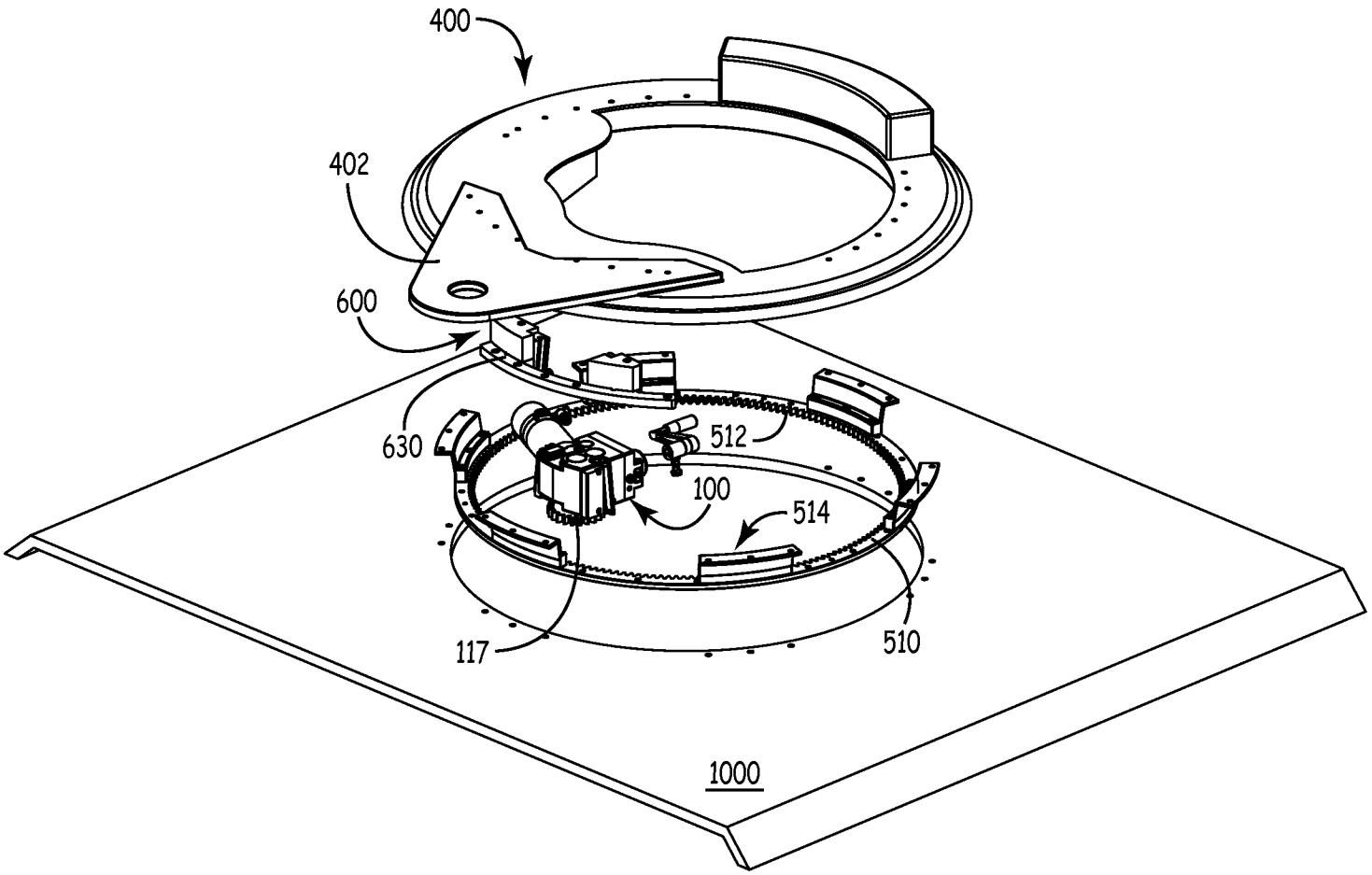
FIG. 29 is an exploded view of the system including a motor unit, a ring gear, and a turret consistent with the technology disclosed herein.
Figure 30:
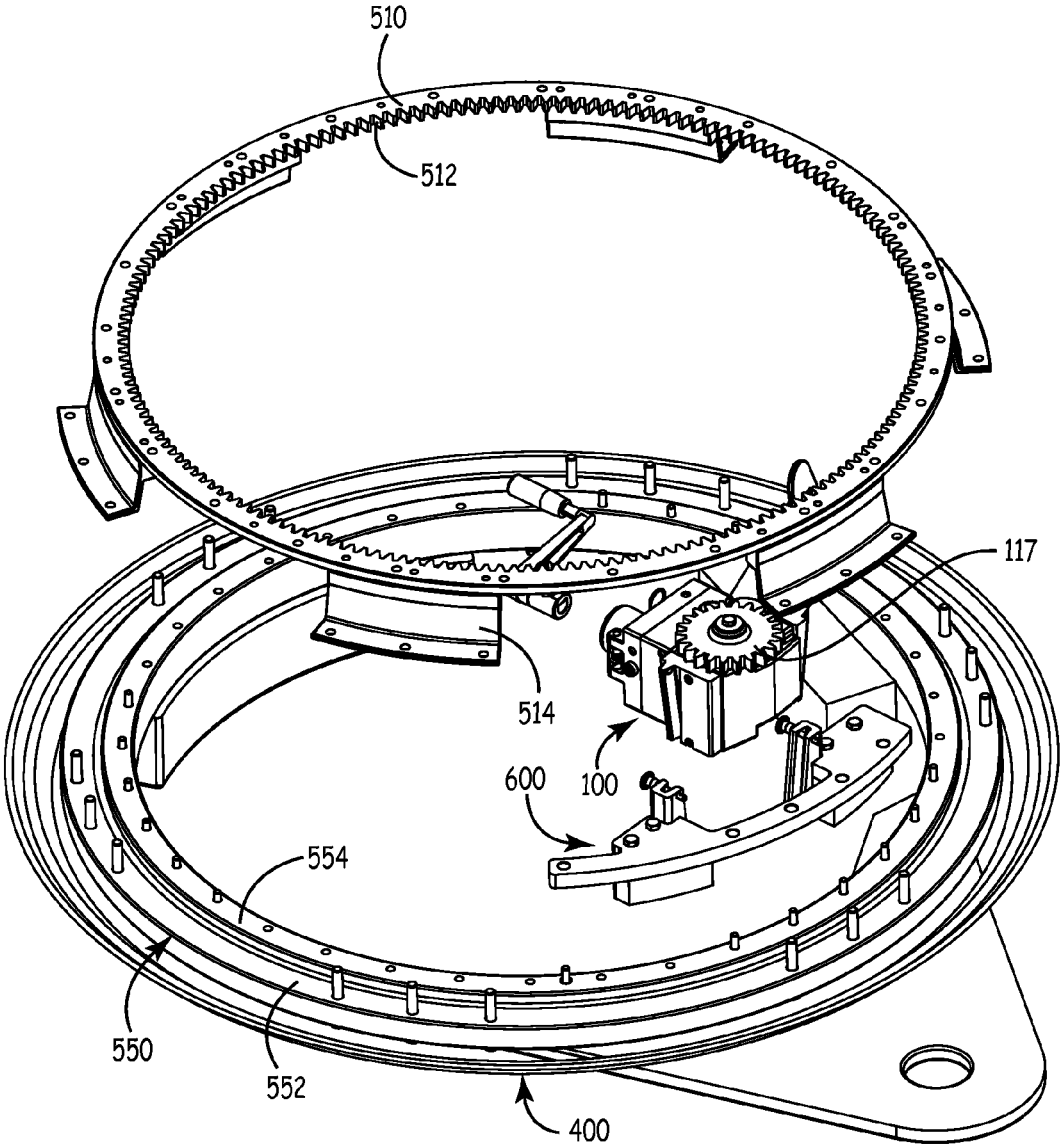
FIG. 30 is an exploded underside view of the system including a motor unit, a ring gear, and a turret consistent with the technology disclosed herein.

As previously referred to, FIG. 10 depicts the motorized system 100 of the technology disclosed herein mounted to a turret 400 having radius R. The motor unit 100 is configured to be in mechanical communication with, and cause rotation of, the turret 400. The gear box 110 is coupled to the turret 400 and has a drive gear 117 fixed to a drive shaft 116 that is in direct engagement with corresponding teeth 512 on a ring gear 510 on a vehicle body 500. FIG. 25 depicts a motor unit 100 in communication with the ring gear 510, where the turret has been omitted for clarity. FIGS. 29 and 30 depicts an exploded view of the motor unit 100 in communication with the ring gear 510. FIG. 29 further depicts the ring gear 510 mounted on a first structure 1000 such as a vehicle. FIG. 26 depicts the motor unit mounted to an inner race 554 of a bearing 550 and a portion 402 of a turret 400 (See FIG. 29), where the motor unit 100 is in communication with the ring gear 510. The drive gear 117 is generally fixed relative to the motor unit 100 and a second structure 400, which is a turret in the current embodiment. The ring gear teeth 512 are defined circumferentially around the inside perimeter of the ring gear 510. The second structure 400 is rotatably disposed on the first structure 1000 such that when the drive gear 117 progresses along the teeth 512, the second structure 400 rotates.

Figure 22:
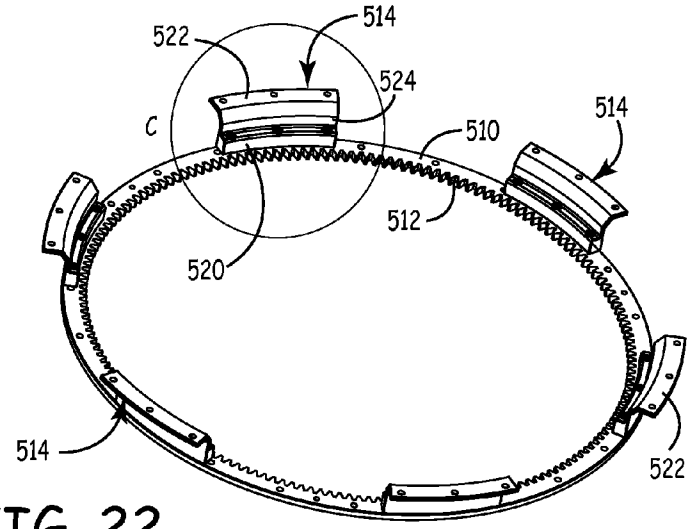
FIG. 22 depicts a bottom view of a ring gear having stand-offs consistent with the technology disclosed herein.
Figure 23:
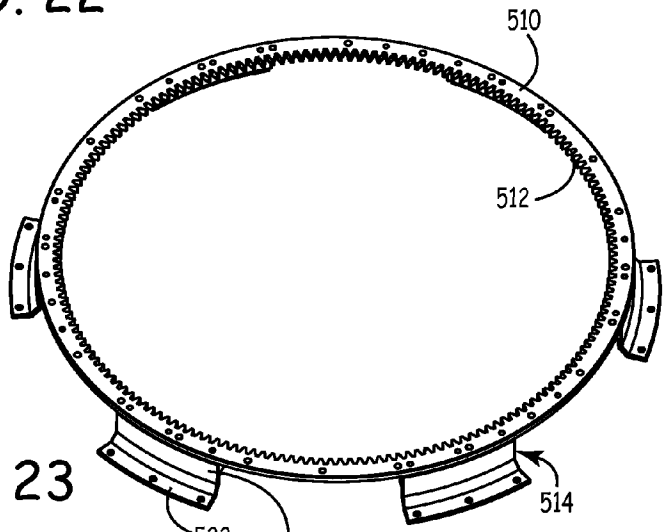
FIG. 23 is a top view of the ring gear having stand-offs of FIG. 22.
Figure 24:
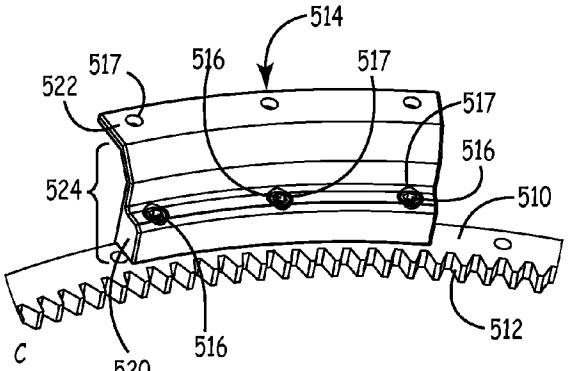
FIG. 24 depicts detail C of FIG. 22.

In a variety of implementations of the current technology the ring gear 510 and the drive gear 117 are involute, which can provide advantages over gear teeth having a non-involute profile. One example advantage is relatively quieter operation. Another example advantage is a relatively smoother turret rotation. An involute gear configuration is not necessary for practicing the technology disclosed herein. The ring gear can be an internal spur gear and the drive gear 117 can be an external spur gear. FIGS. 22-24 depict a ring gear consistent with the technology disclosed herein, which will be described in more detail, below.

FIG. 9A is a cross-sectional view of a motor unit 100 that provides a view of the mechanical communication chain between the motor 122 and gears in the gear box 110. The gear box 110 has a first gear 112 that is in mechanical communication with the drive shaft 116 (also visible in FIGS. 1-9, for example) that drives rotation of the turret 400 (visible in FIG. 10, for example). When the motor 122 is in operation, a motor gear 128 rotates and is in mechanical communication with the drive shaft 116 and is configured to cause rotation of the drive shaft. In the embodiment depicted, the motor gear 128 transfers rotation to a second gear 114 within the gear housing, which is in further mechanical communication with the first gear 112. Those skilled in the art will appreciate that gears within the gear housing can have a variety of configurations to transfer rotation from the motor to the drive shaft 116.

A brake lever 124 is in communication with a brake 126 that is in further communication with the motor gear 128. The brake 126 is generally configured to prevent rotation of the drive shaft 116. When the brake lever 124 is in an "engaged" position, the brake 126 is engaged to prevent rotation of the motor gear by default. The brake 126 is automatically disengaged to allow transmission of rotation from the motor to the drive gear 116 when input is provide to a user input device 220 (See FIG. 10). In a variety of embodiments the brake 126 is an electro-mechanical brake. In at least one embodiment the brake 126 is a spring-loaded clutch plate. The brake 126 can also be mechanically disengaged in a variety of embodiments which will be described below in the discussion of the manual input shaft.

Manual Input Shaft

Figure 4:
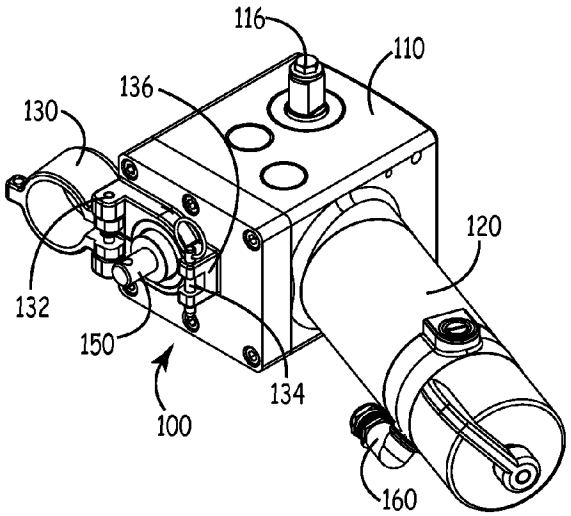
FIG. 4 is a perspective view of the embodiment of FIG. 1 where a drive cap is open to expose a manual input shaft.
Figure 5:
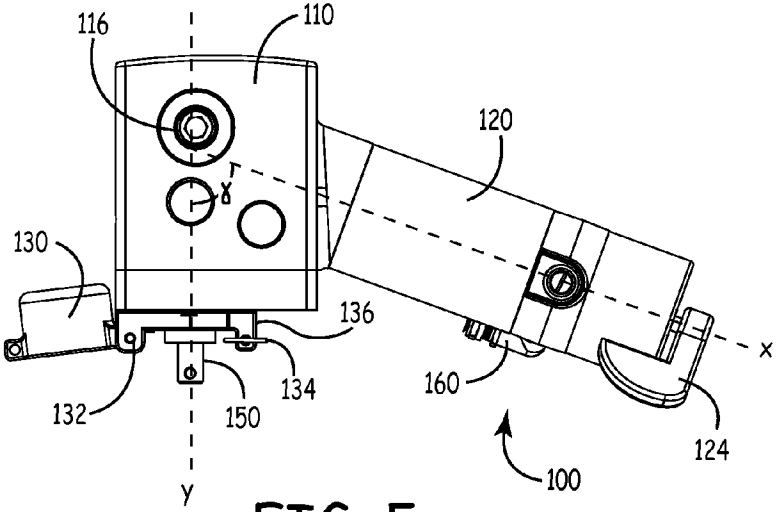
FIG. 5 is a side view of the embodiment of FIG. 4 consistent with the technology disclosed herein.
Figure 6:
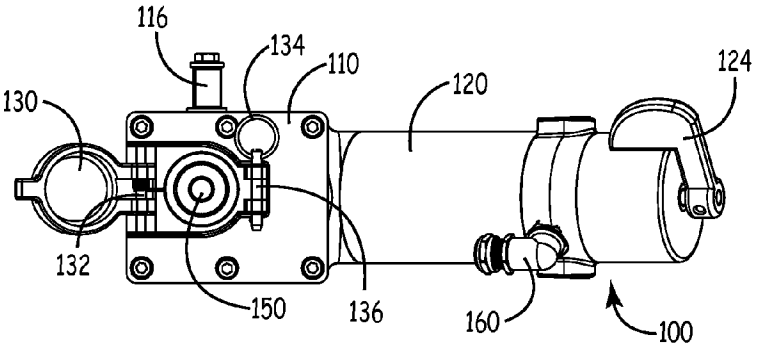
FIG. 6 is a top view of the embodiment of FIG. 4 consistent with the technology disclosed herein.

A manual input shaft, visible in FIGS. 4-6, is incorporated in the gearbox 110, which is useful in the event of an electrical system failure. A manual input shaft 150 is in mechanical communication with the drive shaft 116 and the drive shaft is fixed to the direct drive gear. A drive cap 130 is pivotably coupled to the gear box 110 with a hinge connection 132 such that the drive cap 130 is pivotably disposed over the manual input shaft 150. The side of the drive cap 130 opposite the hinge connection 132 defines a pin opening that substantially aligns with at least one other pin opening defined by the gearbox 110. An override switch 136 can be in communication with the drive cap 130 and be configured to prevent electrical operation of the motor 122 when the drive cap 130 is open. The override switch 136 can be disposed within mechanical proximity of the pin openings such that the override switch 136 is in mechanically engaged and disengaged in response to opening and closing the drive cap 130. A cap pin 134 passes through the substantially aligned pin openings of the drive cap and the gear box.

When the manual input shaft 150 needs to be accessed by a user, the pin is removed and the drive cap 130 is pivoted open about the hinge connection 132 which releases the override switch 136. The override switch 136 is generally a safety switch configured to prevent the electrical operation of the system when the drive cap 130 is opened. Releasing the override switch 136 can interrupt the electrical functioning of the motor, in at least one embodiment, to prevent the motor gear 128 from transmitting rotation to the system. In some embodiments, releasing the override switch 136 prevents a user input device 220 from providing input to the motor. The override switch 136 addresses a safety concern that arises if a hand crank is attached to the manual input shaft and the brake switch is in the "engage" position: If a user input device or joystick is activated, the hand crank 140 (depicted in FIGS. 7-9) and/or the manual input shaft 150 could be spun around with a great deal of force, which could result in injury and winding of hair, clothing, or the like, around the hand crank 140 and/or the manual input shaft 150. When the override switch 136 is open, or the brake lever 124 is positioned to disengage, or both conditions are met, then the user input device 220 cannot operate the motor unit 100.

Figure 7:
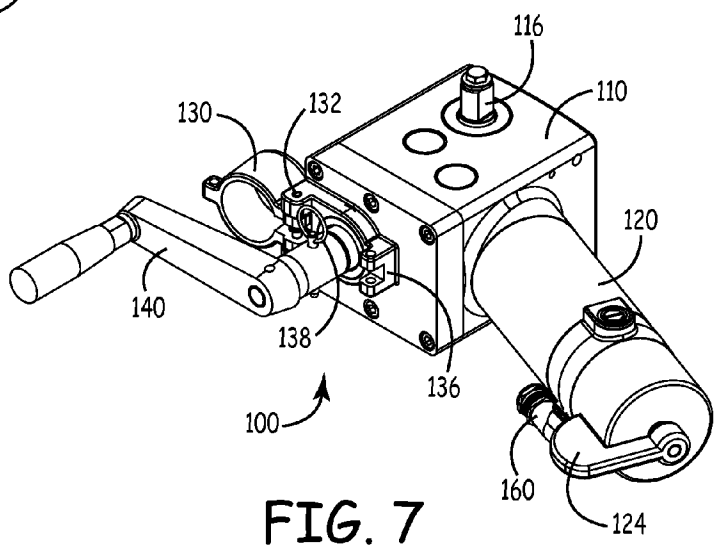
FIG. 7 is a perspective view of the embodiment of FIG. 4 where a handle is attached to the manual input shaft of a system including a motor and a gear box consistent with the technology disclosed herein.
Figure 8:
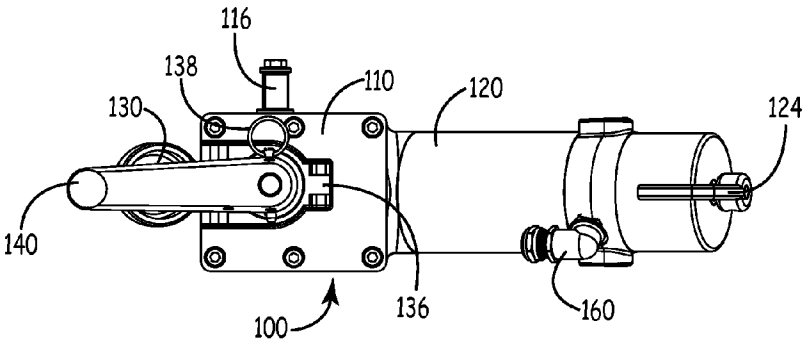
FIG. 8 is a side view of the embodiment of FIG. 7 consistent with the technology disclosed herein.

FIG. 4 depicts the motorized system 100 with the drive cap 130 in an open position to access the manual input shaft 150. When the drive cap 130 is open the manual input shaft 150 is revealed. The manual input shaft 150 transfers rotational energy to a gear system that is coupled to the drive gear 117. FIG. 7 depicts the motorized system 100 with a handle 140 coupled to the manual input shaft 150 to be manually operated. The handle 140 has a coupling end that is configured to removably attach to the manual input shaft 150. Both the coupling end of the handle 140 and the manual input shaft 150 mutually define a pin passage 142 (depicted in FIG. 9A) that receives a handle pin 138. Such a configuration allows rotation of the handle 140 to be transferred to the manual input shaft 150 and eventually to the drive gear 117, thus rotating the turret.

In order to allow the manual input shaft to operate the system, a brake lever 124, as discussed above, which is in operative communication with the system 100 is pivotably disposed on the motor housing 120 to disengage and engage the brake 126 from a gear. In one implementation, the brake lever 124 can also be configured to engage and disengage a manual input shaft to be in operative communication with the drive shaft 116. The brake lever 124 can also be configured to engage and disengage the user input device 220. The manual input shaft will be described in more detail below. As discussed above, the override switch 136 prevents electrical operation of the system when the drive cap 130 is open.

FIG. 9A is a cross-sectional view of FIG. 9 consistent with the technology disclosed herein. Before connecting the handle 140, the override switch 136 is released by opening the drive cap 130. The handle 140 can be connected by coupling the handle 140 to the manual input shaft 150. In at least one embodiment the handle 140 defines an opening that is configured to receive a portion of the manual input shaft 150. In such an embodiment a handle pin 138 is mutually received by an opening cumulatively defined by the manual input shaft 150 and the handle 140. In one embodiment the handle pin 138 is a spring pin.

Before operating the handle 140, the brake lever 124 is pivoted to a "disengaged" position, to disengage the brake from the system. In the embodiment depicted in FIG. 9A, the brake 126 disengages from the motor gear, which allows rotation of all the gears in the system including the manual gear 152. The handle 140 mechanically couples to the manual input shaft 150 with a handle pin 138 (depicted in FIGS. 7-9), such that manual rotation from the handle 140 is transmitted to the manual input shaft 150. Such rotation is transferred from the manual input shaft 150 to a manual drive gear 152 coupled thereto, which eventually transmits rotation to a first gear 112 in mechanical communication with the drive shaft 116 discussed above in the discussion of FIG. 7.

When the turret has been manually rotated to a desired position, the brake lever 124 can be pivoted to its "engaged" position, to engage the brake 126 in the system such that further rotation is prevented. Because engaging the brake 126 further engages the motor as described above, the override switch 136 acts as a back-up to prevent motorized operation of the system 100 despite having engaged the brake 126. It will be appreciated by those skilled in the art that alternate configurations for the braking system are within the scope of the technology disclosed herein. Further, it will be appreciated by those skilled in the art that gear couplings within the gear box 110 can have a variety of configurations to transmit the manual rotation of the handle 140.

The motor unit 120, the gear box 110, and the manual input shaft 150 are a single system and can be housed in a single exterior housing structure. This can be a significant improvement from prior art systems where only a manual drive mechanism was provided, but was a component that was separate from a motor which was also capable of driving the turret. Because these components are housed in a single system, the system is more compact and uses significantly fewer components than some previous manual and/or motorized systems.

System Status Indicators

In one embodiment, two LED lights are electrically coupled to the system to provide system status-indicators based on the color of light that is displayed to a user. In another embodiment there are three LED lights, where the first LED light displays red, the second LED light displays yellow, and the third LED light displays green, where each color represents a different system status.

In a variety of embodiments the brake 126 (visible in FIG. 9A) incorporates one or more micro-switches that indicate system status. The micro-switches can be in electrical communication with a control unit in the system, which conveys that information to a user interface output such as LED lights on a system status indicator. One or more micro-switches can interface with the LED lights to indicate the status of the brake in one embodiment.

Mounting Bracket

A mounting bracket provides a means of attaching a motorized system to a turret. The mounting bracket can be configured for ease in attaching the system to a turret. The mounting bracket can also be configured for ease in replacing a first motorized system with a second motorized system, should that become necessary. In the embodiment shown in the figures, no tools are required to replace a first motorized system having the slide flanges with a second motorized system having the slide flanges.

Figure 28:
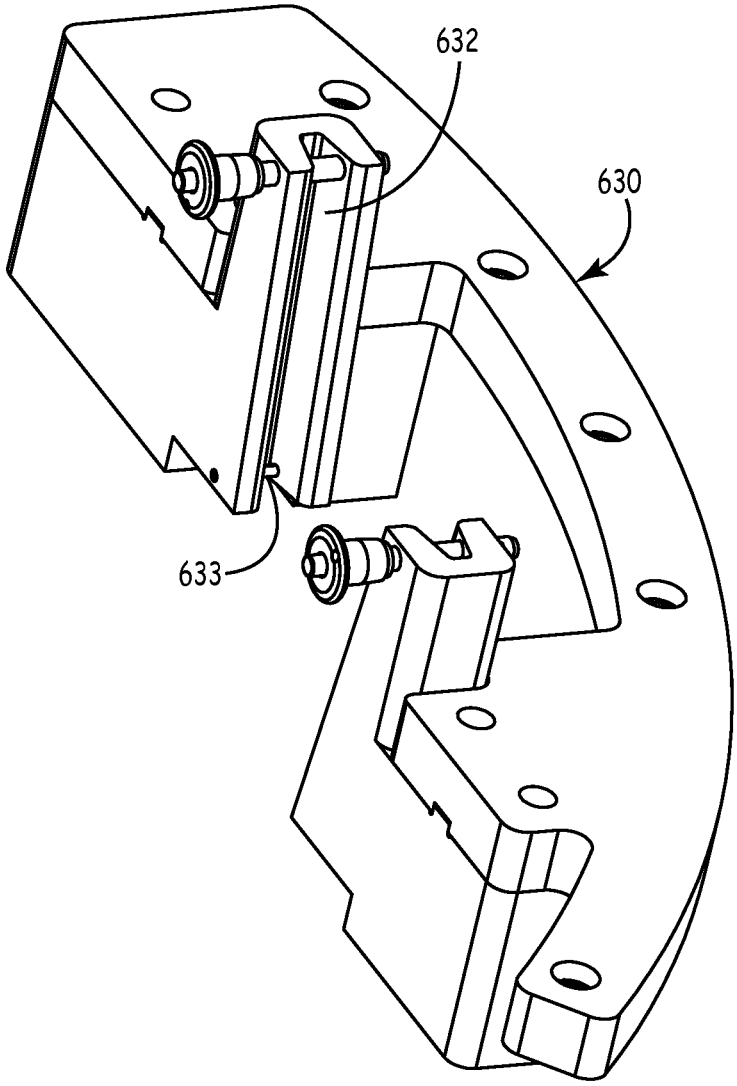
FIG. 28 is a bottom view of an additional embodiment of the mounting bracket, consistent with the technology disclosed herein.

FIGS. 11-16 depict a mounting bracket 300 consistent with the technology disclosed herein and FIGS. 17-20 depict a motorized system 100 consistent with the technology disclosed herein mounted on the mounting bracket of FIGS. 11-16. FIG. 25 depicts an alternative embodiment of a mounting bracket 300 having a motor unit 100, where the motor unit 100 is in communication with a ring gear 510. FIG. 26 depicts the mounting bracket 600 of FIG. 25 having a motor unit 100 in communication with the ring gear 510, where the mounting bracket 600 is coupled to a portion of the turret 400. FIG. 28 also depicts the alternate embodiment of the bracket frame 630 of the mounting bracket 600 of FIG. 25 consistent with the technology disclosed herein.

The mounting bracket is generally configured to couple to, and therefore mount a motorized system to, a structure. In a variety of embodiments the structure can be a turret. In other embodiments the structure could be a vehicle. Those skilled in the art will appreciate that the motorized system 100 can be coupled to a variety of locations and still remain within the scope of the current technology. In multiple implementations the motorized system only need be mounted to a location that allows mechanical communication between the motorized system and the turret such that mechanical movement of the motorized system is transferred to the turret. Examples of such mounting locations include the turret, a turret bearing, and the vehicle frame proximate to the turret.

Referring now to FIGS. 11-16, the mounting bracket 300 has a bracket frame 330 having two mounting surfaces 338 with a mount flange 336 coupled thereto, where the mounting surfaces 338 and mount flange 336 are substantially perpendicular and the mount flange 336 has a curvature consistent with the structure to which it will be mounted (such as a turret). The mounting bracket 300 further defines a first slide channel 332 and a second slide channel 332 that each slidably receive a first slide flange 312 and a second slide flange 312 of motor unit couplers 310, where the motor unit couplers 310 are configured to couple to a motor unit or a gear box of a motor unit. In one embodiment at least the first motor unit coupler and the mounting bracket are configured to allow mechanical communication between the motor unit and an internal ring gear. A pin 320 is mutually received by a substantially aligned pin aperture 314 defined by each motor unit couplers 310 and corresponding frame pin apertures 334 defined by the bracket frame 330 on each side of the slide channels 332.

The motor unit couplers 310 are configured to receive a motor unit 100. In various embodiments the motor unit couplers 310 are particularly configured to receive a gear box 110 of the motor unit 100. In such embodiments the motor unit couplers 310 are further configured to slidably and removably couple the motor unit 100 to the mounting bracket 300. The motor unit couplers 310 each have a coupling surface 316 that defines a coupling aperture 318, where the coupling apertures 318 are configured to substantially align with corresponding apertures on the gear box 110 and receive one or more couplers such as screws, bolts and the like, which couple the motor unit couplers 310 to the gear box 110. The coupling surface 316 can incorporate different and varying methods to couple to a motor unit 100. For example, the coupling surface 316 could incorporate the use of clamps, adhesives, and the like, as means for coupling each motor unit coupler 310 to the motor unit 100 and/or gear box 110. In at least one embodiment the motor unit couplers are integrated in the motor unit housing itself, such as on the gear box 110.

The slide flanges 312 of the motor unit couplers 310 can be considered a first mating surface that is configured to be slidably received by slide channels 332, which are a second mating surface defined by the mounting bracket 300. Other shapes and configurations of the first mating surface and the second mating surface are within the scope of the technology disclosed herein. In an embodiment such as that depicted in FIG. 28, the mounting bracket 630 defines a stop pin 633 within each slide channel 632 to prevent progressing the slide flanges beyond a particular point in the slide channel 632. Other approaches to securing motor unit couplers 310 to the bracket frame 330 can be used. For example, the bracket frame 330 could be clamped to the motor unit couplers 310. In another example, the material of the bracket frame 330 surrounding each slide channel 332 could frictionally engage a slide flange 312 of each motor unit coupler 310. In yet another example, a tensioned component of the slide flange 312 could frictionally engage the bracket frame 330 defining the slide channels 332. In one other example, the motor unit itself could define at least a first mating surface that is configured to be received by the second mating surface of the mounting bracket. In such an example, the motor unit could also define a third mating surface that is configured to be received by a fourth mating surface of the mounting bracket.

Upon appropriate progression of each slide flange 312 along each respective slide channel 332, and with the drive gear 117 (depicted in FIG. 27) properly mated with the ring gear 510 (depicted in FIG. 26), the pin aperture 314 defined by each slide flange 312 will substantially align with corresponding frame pin apertures 334 defined by the bracket frame 330 on each side of the slide channels. The pins 320 can then be at least partially inserted through the substantially aligned pin aperture 314 and corresponding frame pin apertures 334, thus aligning the motor in an appropriate position.

Figure 17:
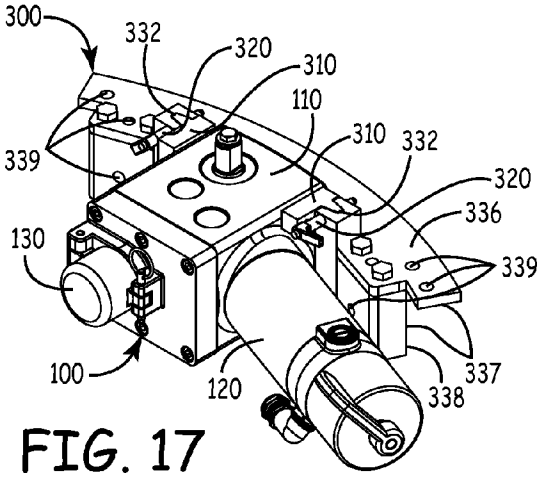
FIG. 17 is a perspective view of a motor unit mounted on a mounting bracket consistent with the technology disclosed herein.
Figure 18:
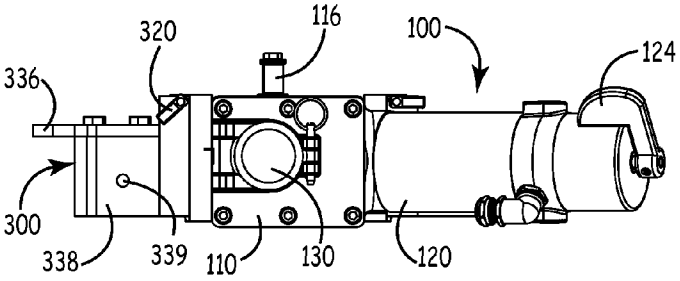
FIG. 18 is a side view of a motor unit mounted on a mounting bracket consistent with the technology disclosed herein.
Figure 19:
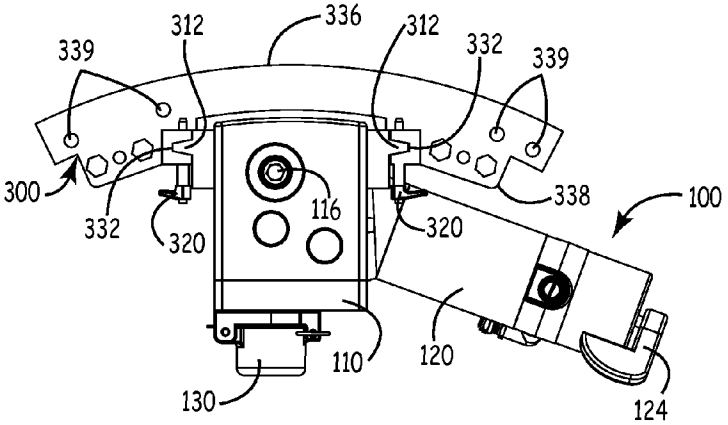
FIG. 19 is a top view of a motor unit mounted on a mounting bracket consistent with the technology disclosed herein.
Figure 20:
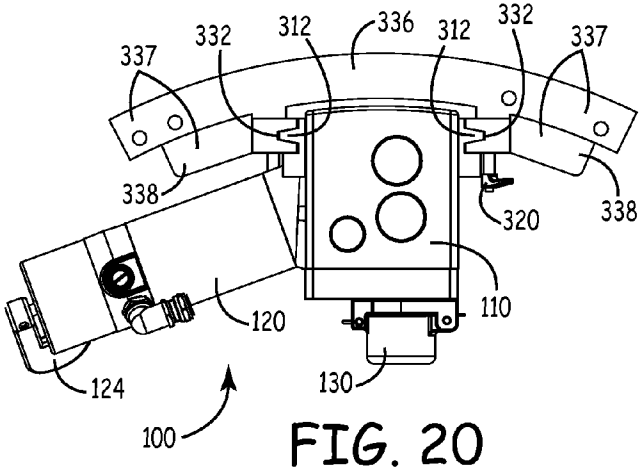
FIG. 20 is a bottom view of a motor unit mounted on a mounting bracket consistent with the technology disclosed herein.

Both the mount flange 336 and the mount surfaces 338 of the bracket frame 330 define mounting apertures 339 that are configured to receive coupling components such as screws, bolts, and the like, that couple the mounting bracket 300 to a structure. As mentioned above, that structure can be a turret in a variety of implementations of the technology disclosed herein. Relative to the orientation of the mounting bracket 300 in FIG. 17, the mount flange 336 extends past the mount surface 338 such that the back surface of the mount surface 338 and the bottom surface of the mount flange 336 mutually define a contact surface 337 that is configured to contact two sides of a structure. The underside of the configuration depicted in FIG. 17 is depicted in FIG. 20. In one embodiment the turret can have an elevated portion or "shelf" that substantially contacts the contact surfaces 337 of the mount surfaces 338 and mount flange 336.

The turret typically has a mostly planar turret plate that divides the outside of the vehicle from the inside of the vehicle. The turret plate typically has a circular border (as visible in the FIG. 10 schematic), and has an outside top surface and an inside bottom surface. In one embodiment, the motorized system described herein will be mounted to the inside bottom surface of that turret plate.

FIGS. 17-20 depict the motor unit consistent with the technology disclosed herein mounted to the mounting bracket of FIGS. 11-16. The gear box 110 of the motor unit 100 is coupled to the motor unit couplers 310 which have slide flanges 312 that are slidably deposited in corresponding slide channels 332 defined by the bracket frame 330 (depicted in FIG. 11) of the mounting bracket 300. Pins 320 are received by frame pin apertures defined by the bracket frame 330 on each side of the slide channels 332, where the frame pin apertures 334 substantially align with pin apertures 314 (not visible in this view) defined by the slide flanges 312.

Ring Gear and Stand-Offs

As described above, the ring gear is generally in direct engagement with the drive gear of the motor unit, which results in the rotation of the turret. FIGS. 22-24 depict a ring gear 510 consistent with at least one embodiment of the technology disclosed herein.

The ring gear 510 is an internal gear such that its gear teeth 512 are directed towards the center of the ring gear 510. In various embodiments the gear teeth 512 are involute. In a variety of embodiments the ring gear 510 is a single cohesive unit. The ring gear 510 is coupled to a plurality of stand-offs 514. In the current embodiment, there are six stand-offs 514, but those of skill in the art will appreciate that there can be one, two, four, seven, or other numbers of stand-offs. The ring gear 510 couples to the stand-offs 514 through any means known in the art, and in this particular embodiment is coupled to the stand-offs 514 with bolts 516 passing through apertures mutually defined by the ring gear 510 and the stand-offs 514 (See FIG. 24). In another embodiment the ring gear 510 incorporates the stand-offs 514 in a unitary structure.

The stand-offs 514 can have a variety of configurations and in one embodiment are constructed from 6061-T6 aluminum and anodized with a hard anodic coating. The stand-offs 514 are further configured to couple to a vehicle, and provide height between the vehicle and the ring gear 510 within which the motor unit 100 can be accommodated. Each stand-off has a first coupling flange 520 a second coupling flange 522, and a rise 524.

The first coupling flange 520 defines a surface that is configured to couple to a ring gear 510. In this particular embodiment, the first coupling flange 520 has a width and curvature that fits within the bottom surface of the ring gear 510. In this particular embodiment the first coupling flange defines coupling apertures 517 configured to receive a coupling component 516 such as a bolt or a screw. The rise 524 of the stand-off 514 can have a variety of configurations, and generally provides vertical space between the first coupling flange 520 and the second coupling flange 522. Stand-offs 514 having a rise 524 with a first measurement can be appropriate to use with a ring gear mounted to a first mounting surface, and alternate stand-offs with a rise 524 having a second measurement can be appropriate to use with a ring gear mounted to a second mounting surface. Such varying stand-off configurations allow various mounting surfaces to be accommodated. In a variety of embodiments the mounting surfaces are vehicles.

Figure 27:
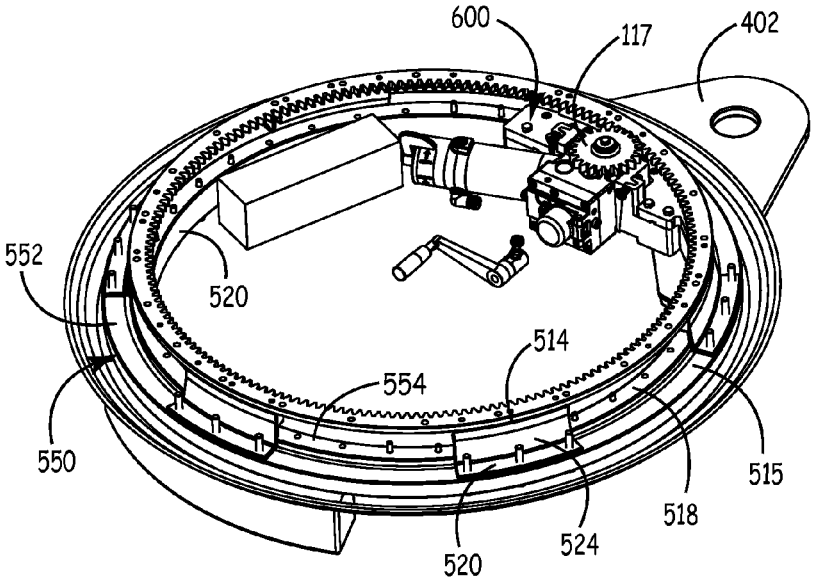
FIG. 27 is a bottom view of the assembly depicted in FIG. 26.

The second coupling flange 522 defines a surface that is configured to couple to a vehicle. The second coupling flange 522 can have a width and a curvature to accommodate the surface to which it is configured to attach. In this particular embodiment, the second coupling flange 522 defines coupling apertures 517 configured to receive a coupling component such as bolts or screws. In various embodiments the stand-offs 514 range from 2-3 inches high. FIG. 27 depicts the stand-offs 514 coupled to a ring gear 510, where the stand-offs 514 are also coupled to the outer race 552 of a bearing 550 that is coupled to a first structure such as a vehicle. The inner race 554 of the bearing 550 is configured to be coupled to a second structure such as a turret.

Example Implementations

Figure 21:
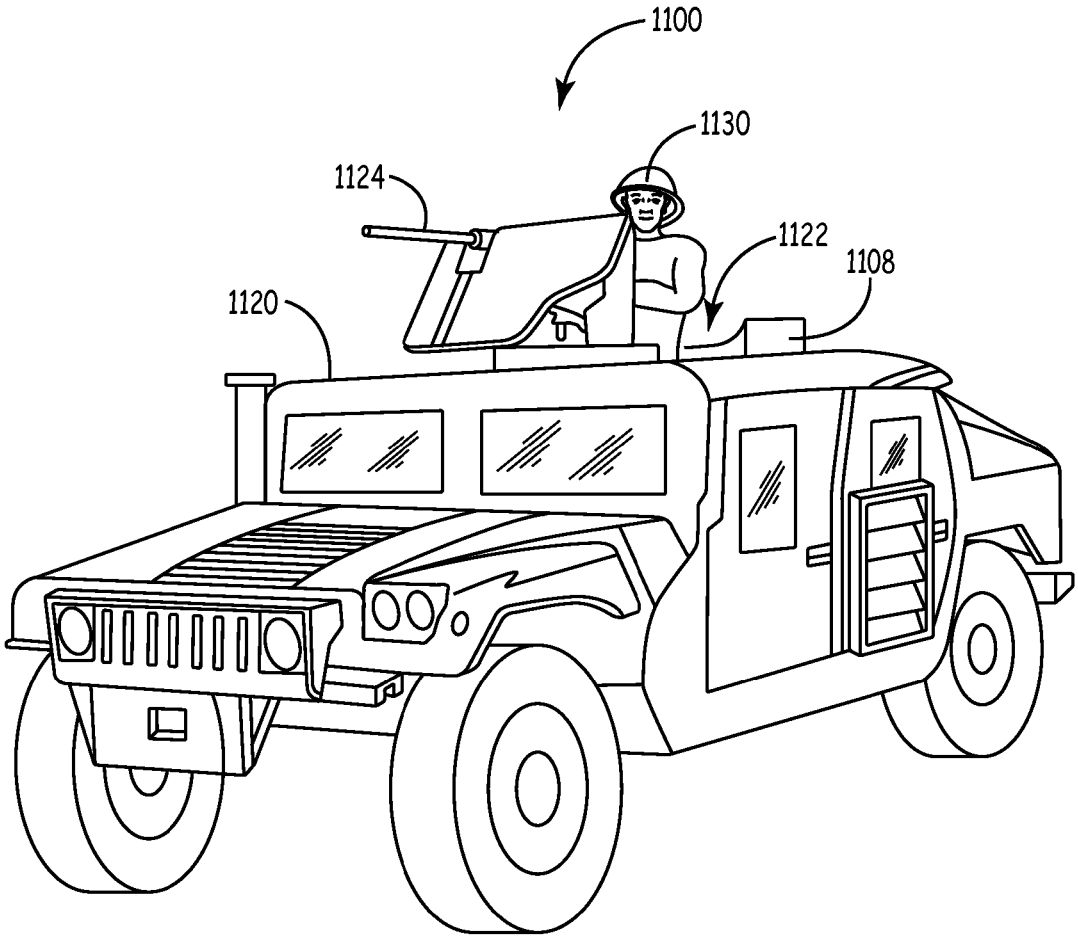
FIG. 21 is an example implementation of a motor unit in a vehicle consistent with the technology disclosed herein.

FIG. 21 illustrates a military vehicle having a turret that can make use of a battery-powered motor unit as described herein and is intended to show the context of use of the embodiments described herein. A system 1100 is used in connection with a vehicle 1120 or other structure having a rotatable turret 1122 mounted thereon. The turret 1122 is generally separate from the vehicle frame 1120 and generally rotates in the vehicle frame 1120. In other embodiments the turret 1122 can have armored side plates, and armored back plate, armored windows, and/or an armored roof. The system 1100 is generally operated by an operator 1130. The operator 1130 can rotate the turret 1122 relative to the position of the vehicle body 1120. The operator 1130 may operate a user interface to effect the desired rotation of the turret 1122.

A power supply 1108 is generally mounted on the turret 1122, although many other alternatives for location of the power supply are possible. A motor unit is coupled to the underside of the turret 1122. The power supply 1108 is generally mounted on the vehicle frame 1120 and supplies electrical power to the motor through a controller.

In particular embodiments, the components such as the turret, ring gear, drive gears, mounting brackets and other components can be constructed of tough durable materials such as steel and aluminum alloys. Examples include AISI 4140 steel, AISI 8620 steel, or 6061 aluminum alloy. Some components in some embodiments are coated with protective coatings, lubricant-reducing coatings or coatings that serve multiple purposes. One example of a useful coating for some components is a thermally cured $MoS_2$-based solid film lubricant with an organic binder system. In one embodiment, a coating marketed as 620C/9002 by Everlube Products of Peachtree City, Ga. is used. Components have an anodized coating in some embodiments. Anodized coatings can also be used such as hard, dyed anodic coatings in certain embodiments. Certain materials can also be carborized, heat treated, quenched, and tempered. In some embodiments, certain gear components have an involute profile, a diametral pitch of 5 and a pressure angle of 20°. In one particular embodiment, a ring gear can have a 38-inch diameter, a width of 1.25-inches, and be 0.5 inches thick.

In at least one embodiment, the motor unit 100 has a gear reduction of 54.7:1. In one embodiment, the motor unit 100 is capable of 66 rotations per minute without a load bearing on the drive gear.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as "arranged", "arranged and configured", "constructed and arranged", "constructed", "manufactured and arranged", and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

This application is intended to cover adaptations or variations of the present subject matter. It is to be understood that the above description is intended to be illustrative, and not restrictive.

What is claimed is:

1. A turret-rotating motor system comprising:

a main drive gear configured to engage a geared perimeter of a circular ring gear, wherein the main drive gear and the circular ring gear move relative to one another in response to rotation of the main drive gear;

a motor having a motor shaft operable to rotate in response to operation of the motor; and, a manual input shaft operable to rotate in response to a manual user input to rotate a handle while the handle is releasably coupled to the manual input shaft, wherein rotation of any one of the motor shaft, the manual input shaft and the main drive gear imparts rotation upon the other two, and such that rotation of the handle while coupled to the manual input shaft imparts rotation upon the motor shaft, the manual input shaft and the main drive gear, wherein a longitudinal axis of the motor shaft is oriented in a plane parallel to a plane containing the circular ring gear, and wherein the motor shaft, the manual input shaft and the main drive gear are in continuous mechanical communication in all operating modes.

2. The turret-rotating motor system of claim 1, wherein the geared perimeter of the circular ring gear is an inside perimeter of the circular ring gear.

3. The turret-rotating motor system of claim 1, wherein a longitudinal axis of the manual input shaft is oriented in a plane parallel to the plane containing the circular ring gear.

4. The turret-rotating motor system of claim 1, wherein, from a plan view perspective of the circular ring gear, the motor is located interior to an inside perimeter of the circular ring gear.

5. The turret-rotating motor system of claim 1, further comprising the handle operable to releasably couple to the manual input shaft.

6. The turret-rotating motor system of claim 5, further comprising an interlock module operative to enable and/or disable operation of the motor, wherein while the handle is coupled to the manual input shaft, the interlock module disables operation of the motor, and after the handle is removed from the manual input shaft, the interlock module enables operation of the motor.

7. The turret-rotating motor system of claim 1, further comprising a quick-attachment module configured to mount the turret-rotating motor system in a location to allow mechanical communication between the motor and the circular ring gear, the quick-attachment module comprising two slide couplers each configured to slidably engage a complementary slide coupler of a mounting bracket by sliding in a common slide direction.

8. The turret-rotating motor system of claim 7, wherein one of the two slide couplers has a securing aperture configured to receive a securing pin, wherein when the turret-rotating motor system is slidably engaged with the mounting bracket, the securing aperture aligns with a retaining aperture in the complementary coupler such that the pin may be inserted through both the retaining aperture and the securing aperture to secure the turret-rotating motor system to the mounting bracket.

9. The turret-rotating motor system of claim 1, wherein for each rotation of the main drive gear, the motor shaft rotates at least about 50 rotations.

10. A turret-rotating motor system comprising:

a main drive gear configured to engage a geared perimeter of a circular ring gear, wherein the main drive gear and the circular ring gear move relative to one another in response to rotation of the main drive gear;

a motor having a motor shaft operable to rotate in response to operation of the motor; and, a manual input shaft operable to rotate in response to a manual user input to rotate a handle while the handle is releasably coupled to the manual input shaft, wherein rotation of any one of the motor shaft, the manual input shaft and the main drive gear imparts rotation upon the other two, and such that rotation of the handle while coupled to the manual input shaft imparts rotation upon the motor shaft, the manual input shaft and the main drive gear, and wherein the motor shaft, the manual input shaft and the main drive gear are in continuous mechanical communication in all operating modes.

11. The turret-rotating motor system of claim 10, wherein the geared perimeter of the circular ring gear is an inside perimeter of the circular ring gear.

12. The turret-rotating motor system of claim 10, wherein, from a plan view perspective of the circular ring gear, the motor is located interior to an inside perimeter of the circular ring gear.

13. The turret-rotating motor system of claim 10, further comprising the handle operable to releasably couple to the manual input shaft.

14. The turret-rotating motor system of claim 13, further comprising an interlock module operative to enable and/or disable operation of the motor, wherein while the handle is coupled to the manual input shaft, the interlock module disables operation of the motor, and after the handle is removed from the manual input shaft, the interlock module enables operation of the motor.

15. The turret-rotating motor system of claim 10, further comprising a quick-attachment module configured to mount the turret-rotating motor system in a location to allow mechanical communication between the motor and the circular ring gear, the quick-attachment module comprising two slide couplers each configured to slidably engage a complementary slide coupler of a mounting bracket by sliding in a common slide direction.

16. The turret-rotating motor system of claim 15, wherein one of the two slide couplers has a securing aperture configured to receive a securing pin, wherein when the turret-rotating motor system is slidably engaged with the mounting bracket, the securing aperture aligns with a retaining aperture in the complementary coupler such that the pin may be inserted through both the retaining aperture and the securing aperture to secure the turret-rotating motor system to the mounting bracket.

17. A turret-rotating motor system comprising:

a main drive gear configured to engage a geared perimeter of a circular ring gear, wherein the main drive gear and the circular ring gear move relative to one another in response to rotation of the main drive gear;

a motor having a motor shaft operable to rotate in response to operation of the motor;

a manual input shaft operable to rotate in response to a manual user input to rotate a handle while the handle is releasably coupled to the manual input shaft; and, means for continuously and mechanically connecting the manual input shaft and the motor shaft to the main drive gear such that rotation of the handle while coupled to the manual input shaft imparts rotation upon the motor shaft, the manual input shaft and the main drive gear, and wherein the motor shaft, the manual input shaft and the main drive gear are in continuous mechanical communication in all operating modes.

18. The turret-rotating motor system of claim 17, wherein the means for continuously and mechanically connecting comprises a gearbox.

19. The turret-rotating motor system of claim 17, wherein the means for continuously and mechanically connecting comprises means for rotating the main drive gear one rotation in response to at least about 40 rotations of the motor shaft.

20. The turret-rotating motor system of claim 17, wherein the means for continuously and mechanically connecting comprises means for rotating the main drive gear in response to rotation of the manual input shaft.

* * * * *